US009567181B2

(12) United States Patent
Tsuji et al.

(10) Patent No.: US 9,567,181 B2
(45) Date of Patent: Feb. 14, 2017

(54) IMAGE FORMING APPARATUS

(71) Applicant: CANON KABUSHIKI KAISHA, Tokyo (JP)

(72) Inventors: Hiroharu Tsuji, Numazu (JP); Masayoshi Fukatsu, Suntou-gun (JP); Yohei Suzuki, Mishima (JP); Daisuke Kaneko, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/394,640

(22) PCT Filed: Mar. 13, 2013

(86) PCT No.: PCT/JP2013/001648
§ 371 (c)(1),
(2) Date: Oct. 15, 2014

(87) PCT Pub. No.: WO2013/157192
PCT Pub. Date: Oct. 24, 2013

(65) Prior Publication Data

US 2015/0102556 A1 Apr. 16, 2015

(30) Foreign Application Priority Data

Apr. 17, 2012 (JP) ..... 2012-094054

(51) Int. Cl.
*B65H 31/24* (2006.01)
*B65H 31/22* (2006.01)
(Continued)

(52) U.S. Cl.
CPC ..... *B65H 31/24* (2013.01); *B41J 13/009* (2013.01); *B41J 13/0045* (2013.01);
(Continued)

(58) Field of Classification Search
CPC ..... B65H 2405/3321; B65H 2405/3322; B65H 31/3027; B65H 31/22; B65H 31/24; B65H 2405/33; B65H 2405/332; G03G 2221/1687; G03G 21/1628
(Continued)

(56) References Cited

U.S. PATENT DOCUMENTS 3,957,264 A * 5/1976 Bach ..... B65H 29/58 271/182
6,874,782 B2 * 4/2005 Hall et al. ..... 271/279
(Continued)

FOREIGN PATENT DOCUMENTS

JP 7-125909 A 5/1995
JP 2003-015373 A 1/2003
(Continued)

*Primary Examiner* — Jeremy R Severson
(74) *Attorney, Agent, or Firm* — Canon U.S.A., Inc. IP Division

(57) ABSTRACT

An image forming apparatus having an apparatus main body includes an image forming unit provided within the apparatus main body, a stacker portion provided on an upper surface of the apparatus main body, and a sheet storage portion provided between the image forming unit and the stacker portion. The image forming unit forms an image on a sheet. The stacker portion may receive, as stacked sheets, sheets on which images are formed by the image forming unit. The sheet storage portion may store, within the apparatus main body, a sheet on which an image is formed by the image forming unit.

19 Claims, 13 Drawing Sheets

(51) Int. Cl.

| | |
|---|---|
| ***B65H 31/30*** | (2006.01) |
| ***B65H 39/11*** | (2006.01) |
| ***B65H 85/00*** | (2006.01) |
| ***B41J 13/00*** | (2006.01) |
| ***B41J 13/10*** | (2006.01) |
| ***G03G 15/00*** | (2006.01) |
| ***B65H 31/00*** | (2006.01) |
| ***B65H 43/00*** | (2006.01) |

(52) U.S. Cl.
CPC ..... *B41J 13/106* (2013.01); *B65H 31/00* (2013.01); *B65H 31/22* (2013.01); *B65H 31/3081* (2013.01); *B65H 39/11* (2013.01); *B65H 43/00* (2013.01); *B65H 85/00* (2013.01); *G03G 15/6538* (2013.01); *B65H 2301/3121* (2013.01); *B65H 2301/4213* (2013.01); *B65H 2402/10* (2013.01); *B65H 2402/441* (2013.01); *B65H 2405/324* (2013.01); *B65H 2405/332* (2013.01); *B65H 2405/354* (2013.01); *B65H 2408/111* (2013.01); *B65H 2408/1143* (2013.01); *B65H 2511/412* (2013.01); *B65H 2601/11* (2013.01); *B65H 2601/321* (2013.01); *B65H 2601/324* (2013.01); *B65H 2801/12* (2013.01)

(58) Field of Classification Search
USPC . 271/298, 279, 287, 297, 303, 305; 399/125
See application file for complete search history.

(56) References Cited

U.S. PATENT DOCUMENTS

| | | | | |
|---|---|---|---|---|
| 7,136,606 | B2 * | 11/2006 | Rose et al. | 399/107 |
| 7,711,310 | B2 * | 5/2010 | Suzuki | G03G 15/00 271/161 |
| 2010/0194036 | A1 * | 8/2010 | Tsuchihashi | B65H 31/24 271/279 |
| 2010/0264581 | A1 * | 10/2010 | Sekiyama et al. | 271/279 |
| 2012/0075657 | A1 * | 3/2012 | Yamamoto | B41J 13/0036 358/1.14 |

FOREIGN PATENT DOCUMENTS

| | | | |
|---|---|---|---|
| JP | 2003-050489 | A | 2/2003 |
| JP | 2003-128325 | A | 5/2003 |
| JP | 2004-326038 | A | 11/2004 |
| JP | 2009-035417 | A | 2/2009 |

* cited by examiner

Fig. 7A]
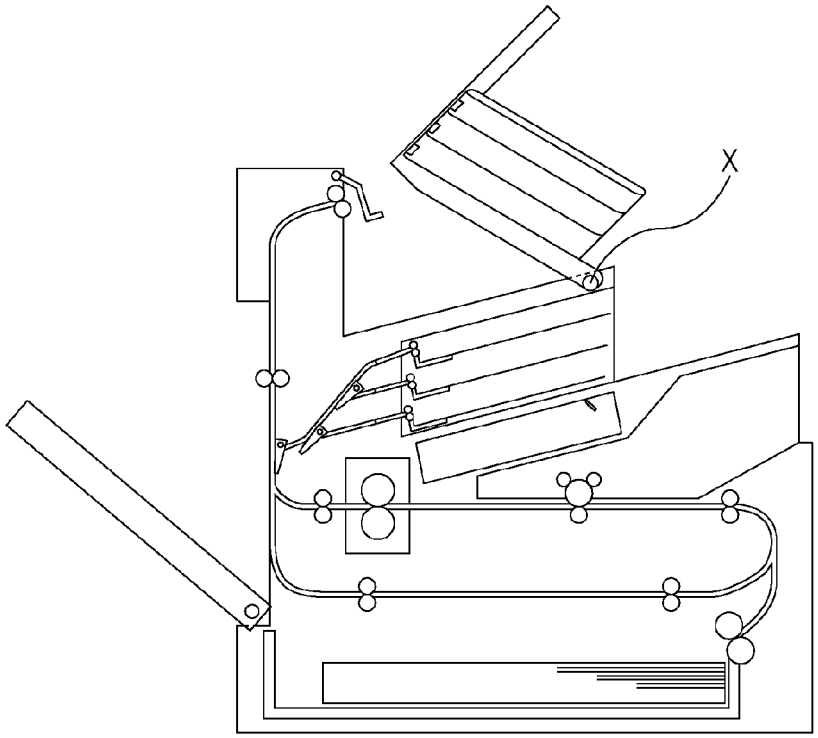
Fig. 7B
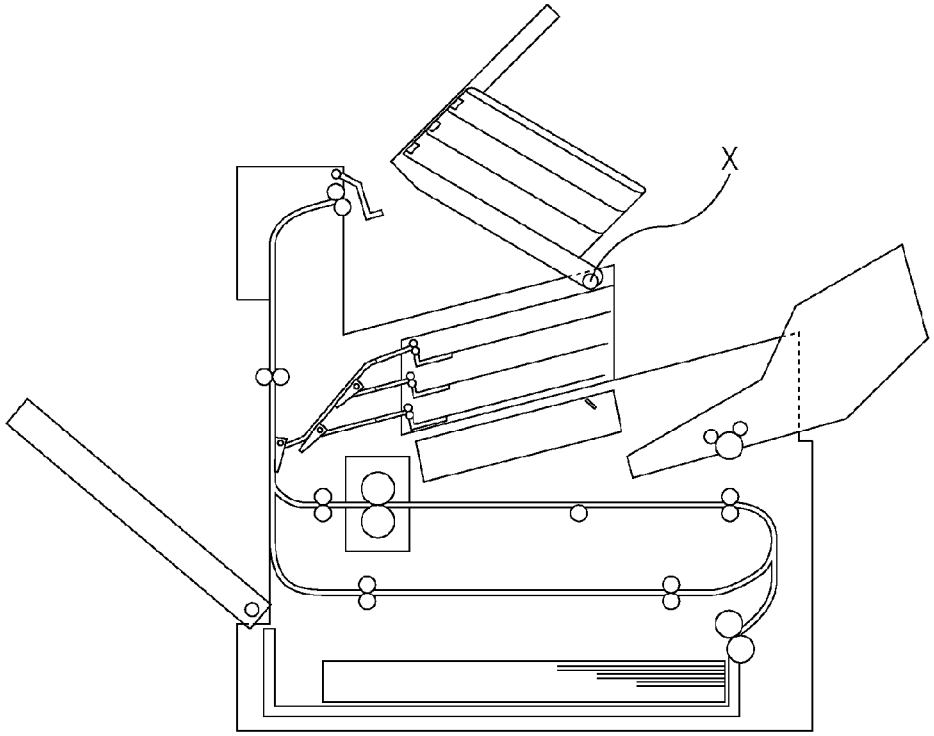

IMAGE FORMING APPARATUS

TECHNICAL FIELD

The present invention relates to an image forming apparatus, in particular to an image forming apparatus including a sheet storage portion that stores a sheet on which an image is formed.

BACKGROUND ART

Conventionally, there are image forming apparatuses such as a copying machine, which are provided with a sheet storage portion such as a mail box that stores a sheet on which an image is formed by an image forming unit.

As an image forming apparatus provided with such a sheet storage portion, PTL 1 describes an image forming apparatus including a plurality of sheet storage portions, which are provided below the image forming unit and are assigned to each user, separately from a normal stacker portion, which is provided on the upper surface of the main body of the apparatus and is shared by a plurality of users. In the image forming apparatus described in PTL 1, it is possible to selectively receive only sheets stored in any one of the sheet storage portions by an operation of a user.

CITATION LIST

Patent Literature

PTL 1: Japanese Patent Laid-Open No. 7-125909

However, in the image forming apparatus described in PTL 1, there is a problem that it is difficult for a user to take the sheets out because the stacker portion on the upper surface of the main body of the apparatus and the sheet storage portions below the image forming unit are located at positions largely away from each other.

SUMMARY OF INVENTION

The present invention provides an image forming apparatus including sheet storage portions and a stacker portion in which it is easy for a user to take sheets out.

According to an aspect of the present invention, an image forming apparatus having an apparatus main body includes an image forming unit provided within the apparatus main body and configured to form an image on a sheet, a stacker portion provided on an upper surface of the apparatus main body and configured to receive, as stacked sheets, sheets on which images are formed by the image forming unit, and a sheet storage portion provided between the image forming unit and the stacker portion, wherein the sheet storage portion is configured to store, within the apparatus main body, a sheet on which an image is formed by the image forming unit.

Advantageous Effects of Invention

According to the present invention, the sheet storage portions that store sheets are provided between the image forming unit and the stacker portion on the upper surface of the main body of the apparatus. Therefore, the stacker portion and the sheet storage portions can be arranged near each other, so that a user can easily take any sheets.

BRIEF DESCRIPTION OF DRAWINGS

FIG. 7A is a diagram showing the first embodiment of the image forming apparatus to which the present invention is applied.

FIG. 7B is a diagram showing the first embodiment of the image forming apparatus to which the present invention is applied.

DESCRIPTION OF EMBODIMENTS

Hereinafter, embodiments of the present invention will be described with reference to the drawings.

First Embodiment

Figure 1:
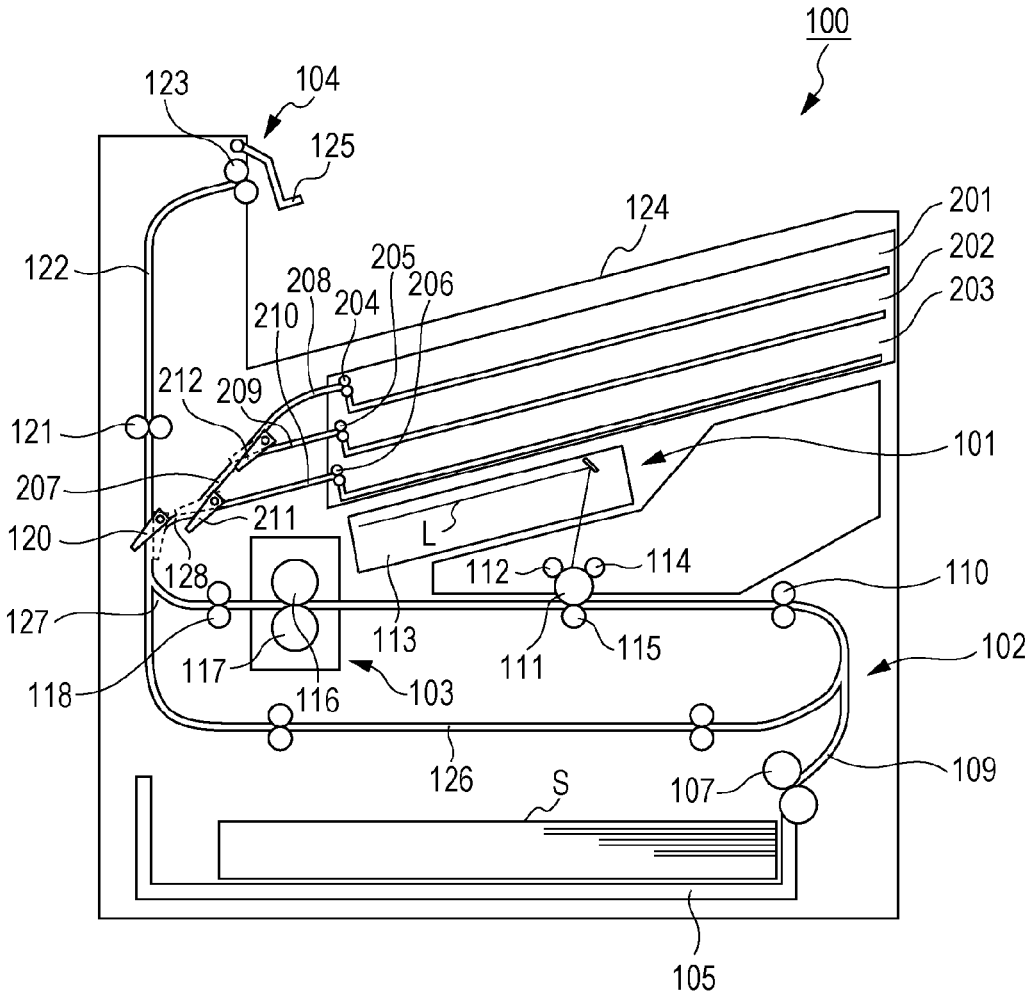
FIG. 1 is a diagram showing a first embodiment of an image forming apparatus to which the present invention is applied.

FIG. 1 shows a schematic cross-sectional view of a monochrome digital printer as an example of an image forming apparatus to which the embodiment is applied.

In FIG. 1, reference numeral 100 denotes an image forming apparatus main body (hereinafter referred to as an "apparatus main body"). An image forming unit 101 is included in the apparatus main body 100. Reference numeral 102 denotes a sheet feeding and conveying unit that feeds and conveys a sheet to the image forming unit 101. Reference numeral 103 denotes a fixing unit that fixes an image onto the sheet. Reference numeral 124 denotes a stacker portion which is provided on the upper surface of the apparatus main body and on which sheets on which an image is formed by the image forming unit are stacked. Reference numerals 201, 202, and 203 denote sheet storage portions which store the sheets on which images are formed by the image forming unit 101 and which is provided between the image forming unit 101 and the stacker portion 124.

Here, the image forming unit 101 includes a photosensitive drum 111 that rotates in a clockwise direction in FIG. 1, an exposure apparatus 113, and a charging roller 112, a developing roller 114, and a transfer roller 115 which are sequentially arranged along a rotation direction of the photosensitive drum 111. The image forming unit 101 forms a toner image on a sheet S by an image forming process.

The sheet feeding and conveying unit 102 includes a sheet feed cassette 105 in which a plurality of sheets S used to form an image are stored in a stacked state, a feed roller 107, a conveying guide 109, and a registration roller 110. The fixing unit 103 includes a fixing roller 116, a pressure roller 117 upward in contact with the fixing roller 116, and a conveying roller 118.

A sheet S re-conveying path 126 used to form images on both sides of the sheet S is provided between a set of the image forming unit 101 and the fixing unit 103 and the sheet feed cassette 105.

In the image forming apparatus of the present embodiment, a plurality of sheet storage portions are vertically stacked. A first sheet storage portion 201, a second sheet storage portion 202, and a third sheet storage portion 203 are stacked in order from the above.

Reference numeral 204 denotes a conveying roller functioning as a conveying unit that conveys a sheet on which an image is formed to the first storage unit 201. Similarly, reference numeral 205 denotes a conveying roller that conveys a sheet to the second storage unit 202 and reference numeral 206 denotes a conveying roller that conveys a sheet to the third storage unit 203.

Reference numeral 120 denotes a conveying path switching member whose position can be switched between a first position which is indicated by solid lines in FIG. 1 and in which the sheet on which an image is formed is moved toward the sheet storage portions and a second position which is indicated by dashed lines and in which the sheet on which an image is formed is discharged to the stacker portion 124. The position of the conveying path switching member 120 can be switched between the position indicated by solid lines in FIG. 1 and the position indicated by dashed lines in FIG. 1 by an actuator not shown in FIG. 1. Reference numerals 121 and 123 denote reverse rotation rollers which can rotate in a normal direction and a reverse direction and which conveys the sheet to the stacker portion 124 by rotating in the normal direction and conveys the sheet to the image forming unit 101 again by rotating in the reverse direction.

When the sheet is discharged to the stacker portion 124, the position of the conveying path switching member 120 is switched to the position indicated by the dashed lines and the sheet is conveyed along a discharge guide 122 by the reverse rotation roller 121 and discharged to the stacker portion 124 by the reverse rotation roller 123. As shown in FIG. 1, the stacker portion 124 is disposed on the upper surface of the apparatus main body and can be used commonly by a plurality of users.

Reference numeral 125 denotes a stacker full detection lever which detects that the stacker portion 124 is filled with sheets stacked thereon. When the stacker full detection lever 125 detects that the stacker portion 124 is filled with sheets, a control unit not shown in FIG. 1 controls so that no image is formed on a sheet until the sheets on the stacker portion 124 are removed.

When images are formed on both sides of the sheet, a sheet where a toner image is fixed onto one side (front side) thereof is conveyed toward the reverse rotation roller 123. After the rear end of the sheet passes through a branch portion 127, the reverse rotation rollers 121 and 123 are rotated in the reverse direction, so that the sheet is switched back and conveyed to the image forming unit 101 through the re-conveying path 126.

When the sheet is conveyed to the sheet storage portions, the position of the conveying path switching member 120 is switched to the position indicated by the solid lines and the sheet is conveyed to the sheet storage portion 200 through a conveying path 128.

Reference numerals 211 and 212 denote respectively a first switching member and a second switching member for switching a path through which the sheet is conveyed. The positions of the first switching member 211 and the second switching member 212 can be switched between the position indicated by solid lines in FIG. 1 and the position indicated by dashed lines in FIG. 1 by an actuator not shown in FIG. 1.

When the sheet S is conveyed to the first sheet storage portion 201, the positions of the first switching member 211 and the second switching member 212 are switched to the positions indicated by the solid lines in FIG. 1 and held. The sheet on which an image is formed passes through the conveying path 128, a conveying guide 207, and a conveying guide 208 in this order, and the sheet is further conveyed to the first sheet storage portion 201 by a conveying roller 204 in a face down state, that is, in a state in which the side on which the toner image is formed faces down.

When the sheet S is conveyed to the second sheet storage portion 202, the position of the first switching member 211 is switched to the position indicated by the solid lines in FIG. 1 and held and the position of the second switching member 212 is switched to the position indicated by the dashed lines in FIG. 1 and held. The sheet on which an image is formed passes through the conveying path 128, the conveying guide 207, and a conveying guide 209 in this order, and the sheet is further conveyed to the second sheet storage portion 202 by a conveying roller 205 in the face down state, that is, in the state in which the side on which the toner image is formed faces down.

When the sheet S is conveyed to the third sheet storage portion 203, the position of the first switching member 211 is switched to the position indicated by the dashed lines in FIG. 1 and held. The sheet on which an image is formed passes through the conveying path 128 and a conveying guide 210 in this order, and the sheet is further conveyed to the third sheet storage portion 203 by a conveying roller 206 in the face down state, that is, in the state in which the side on which the toner image is formed faces down.

Next, a detailed configuration of the sheet storage portions will be described with reference to FIG. 2. In the image forming apparatus of the present embodiment, a plurality of sheet storage portions are vertically stacked. Each sheet storage portion has the same configuration, so that here, the configuration of the first sheet storage portion 201 will be described.

The sheet conveyed to the first sheet storage portion by the conveying roller 204 is temporarily stacked on a stacking surface 231 and stored. Whether or not sheets are placed on the stacking surface 231 is detected by a sheet presence/absence detection unit not shown in the drawings. Reference numeral 233 denotes a push-out unit that pushes a conveying direction upstream end (rear end) of the stored sheets and pushes out a part of the sheets on the downstream side (front end) from a discharge port 234 to the outside of the apparatus main body 100. The sheets are pushed out from the discharge port 234 by the push-out unit 233, so that the user can receive the sheets. In the present embodiment, the length of the stacking surface 231 is set to a length in which the front end of a sheet does not protrude from the discharge port 234 even when a longest sheet that can be stored in the sheet storage portion is stacked.

Figure 2:
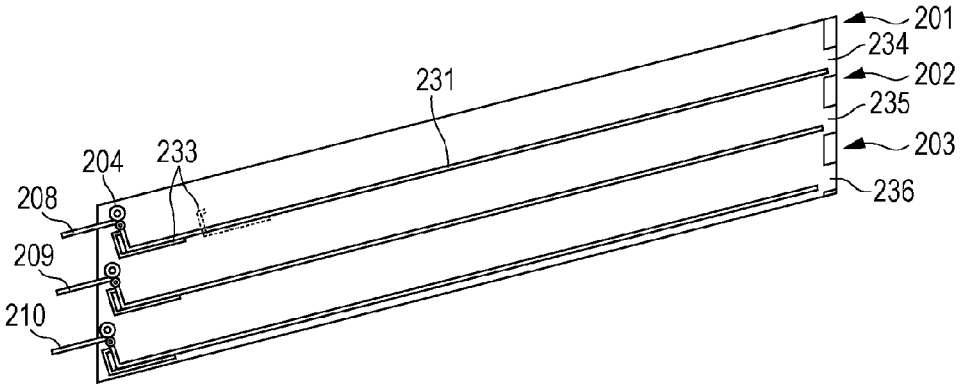
FIG. 2 is a diagram showing a configuration of sheet storage portions of the first embodiment of the present invention.

When a sheet is conveyed to the first storage unit 201, the push-out unit 233 is positioned at a stacking position indicated by solid lines in FIG. 2 at which the push-out unit 233 does not prevent the sheet from being conveyed and stacked. On the other hand, when push-out unit 233 pushes out the stored sheets, the push-out unit 233 moves toward the discharge port 234 along a sheet discharge direction and moves to a push-out position (sheet discharge position) indicated by dashed lines.

Figure 3A:
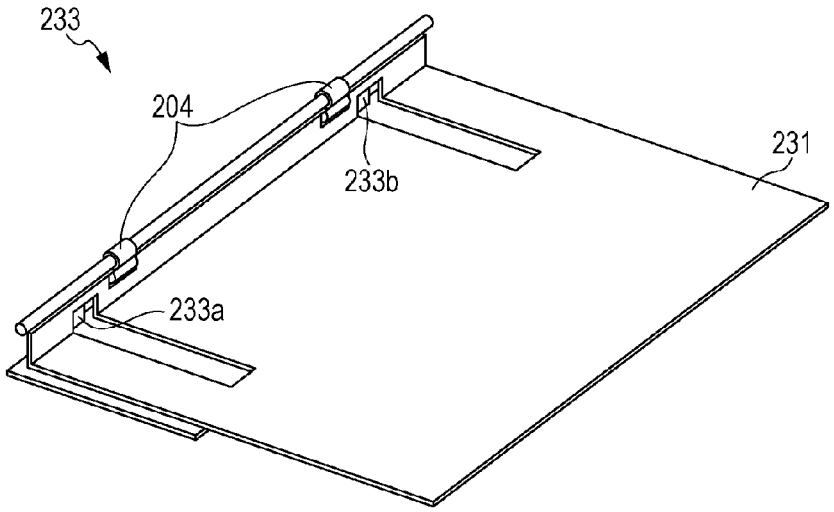
FIG. 3A is a diagram showing a configuration of a sheet storage portion of the first embodiment of the present invention.
Figure 3B:
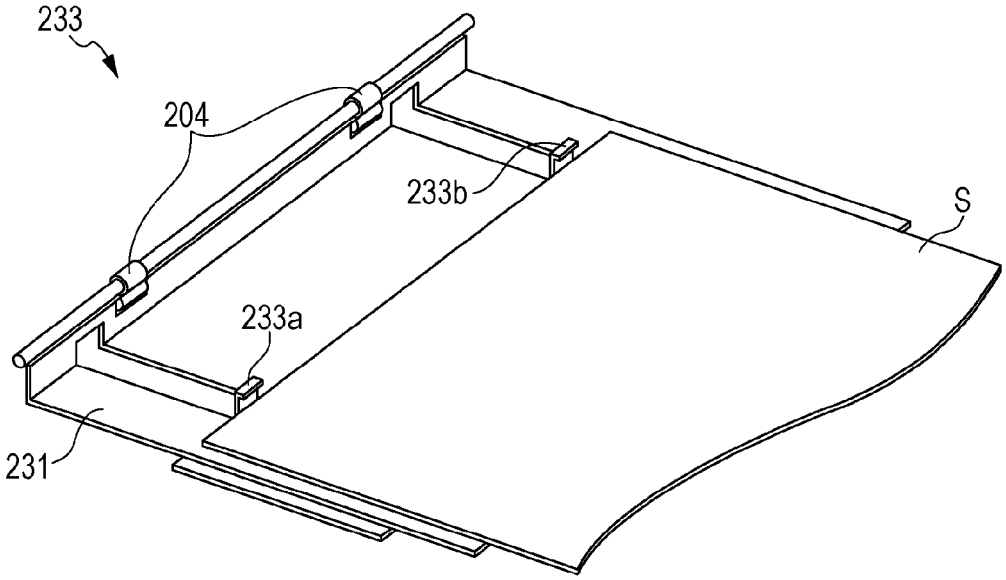
FIG. 3B is a diagram showing a configuration of the sheet storage portion of the first embodiment of the present invention.

FIGS. 3A and 3B are perspective views of the push-out unit 233. FIG. 3A shows a case in which the push-out unit 233 is located at the stacking position and FIG. 3B shows a case in which the push-out unit 233 is located at the push-out position. The push-out unit 233 includes two sheet rear end pressure hooks 233*a* and 233*b* along the sheet width direction in order to prevent the sheets S from being rotated when the sheets S are discharged. The push-out unit 233 pushes out the sheets, the sheet rear end pressure hooks 233*a* and 233*b* push the upstream end of the sheets S to discharge the sheets. The push-out unit 233 is connected to an actuator 239 and the push-out unit 233 reciprocates between the stacking position and the push-out position along the sheet discharge direction when the actuator 239 is driven in a normal direction and a reverse direction.

Figure 4:
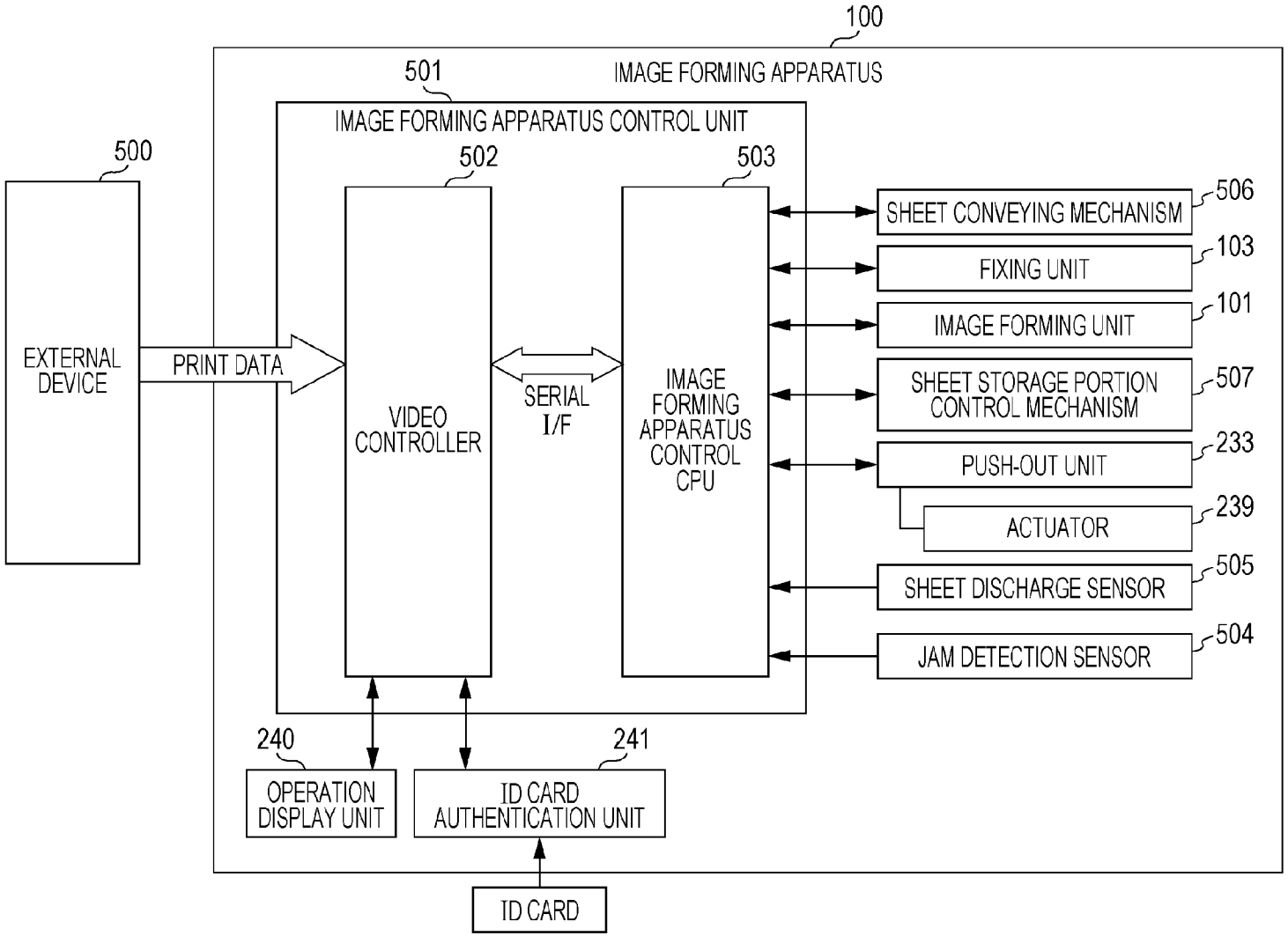
FIG. 4 is a block diagram of an image forming apparatus to which the present invention is applied.

FIG. 4 is a block diagram showing a control unit and a functional configuration of the image forming apparatus shown in FIGS. 1, 2, 3A, and 3B.

The image forming apparatus 100 includes an image forming apparatus control unit 501 as a control unit. The image forming apparatus control unit 501 includes a video controller 502 and an image forming apparatus control CPU 503.

The video controller 502 communicates with an external device 500 such as a host computer and receives print data (including control information such as code data based on a predetermined program language, image data, and the like). Also, the video controller 502 specifies a print condition (paper discharge port and the like) created from the print data to the image forming apparatus control CPU 503 through a serial I/F and issues a print instruction to the image forming apparatus control CPU 503. Also, the video controller 502 instructs the image forming apparatus control CPU 503 to discharge sheets from the sheet storage portions 200 on the basis of user information inputted from an operation display unit 240 and user information obtained from an ID card by an ID card authentication unit 241.

The image forming apparatus control CPU 503 controls printing according to the print condition received from the video controller 502 as well as detects an error such as a jam of the image forming apparatus 100 on the basis of information from the jam detection sensor 504 and notifies the video controller 502 of the error. The image forming apparatus control CPU 503 controls a sheet conveying mechanism 506 and performs feed conveyance and discharge conveyance of a sheet as well as controls the image forming unit 101 and the fusing unit 103 and performs an image forming operation and a fusing operation on the sheet. The image forming apparatus control CPU 503 controls a sheet storage portion control mechanism 507 including conveying rollers 204 to 206 and conveys the sheet on which an image is formed to a sheet storage portion. The image forming apparatus control CPU 503 controls the sheet push-out unit 233 by an instruction from the video controller 502 and performs control to discharge sheets stored in a sheet storage portion by using information of a connected sheet discharge sensor 505.

Next, an operation of the sheet storage portions will be described with reference to FIG. 5. When a user performs a print operation from the external device 500 to the apparatus main body 100, the user can select whether the sheet is discharged to the stacker portion 124 or the sheet is temporarily stored in a sheet storage portion from the external device.

If the user selects that the sheet is stored in a sheet storage portion, the control unit detects a sheet storage portion in which no sheet is stored on the basis of detection results of the sheet presence/absence detection units provided for each sheet storage portion and determines a conveyance destination of the sheet.

For example, when the conveyance destination of the sheet is determined to be the first sheet storage portion 201, the switching member is switched and the sheet is conveyed onto the stacking surface 231 of the first sheet storage portion 201.

Since the control unit has information indicating who's job is stored in what sheet storage portion, it is possible to select a sheet storage portion in which sheets have been already stored as a storage destination if the job is performed by the same user. The user need not select a sheet storage portion to which a job of the user is stored and a sheet is automatically stored in a sheet storage portion to which the sheet can be stored.

In the present embodiment, sheets stored in each sheet storage portion are stored so that the sheets cannot be taken out from the outside of the apparatus main body. The sheets stored in a sheet storage portion are pushed out by the push-out unit by a discharge instruction from a user, so that a discharge operation is started. Examples of the discharge instruction include pressing a discharge operation start button on the operation display unit provided on the apparatus main body, ID card authentication, and issuing a discharge operation start command from an external device connected to the image forming apparatus. Specific methods for issuing the discharge operation start command on an operation unit are as follows: For example, names and personal ID numbers of users who store a job in a sheet storage portion are shown on the operation display unit 240 provided on the apparatus main body 100 shown in FIG. 6 and a user operates a portion corresponding to the user, so that the user can issue the discharge instruction. Or, when a user is authenticated by using an ID card, an ID card authentication unit 241 is attached to the apparatus main body and ID information is acquired from the ID card authentication unit 241, so that the sheet discharge instruction can be issued.

When the video controller 502 receives the sheet discharge instruction, the video controller 502 issues the sheet discharge instruction to the image forming apparatus control CPU 503 and the image forming apparatus control CPU 503 controls the actuator to move the push-out unit from the stacking position to the push-out position.

At this time, information related to users who issued a print instruction of the sheets stored in the sheet storage portions is stored by a storage unit. Since the storage unit stores information indicating who's job is stored in what sheet storage portion, a user need not recognize the sheet storage portion in which the job of the user is stored and the user can receive his or her job when issuing the sheet discharge instruction.

In the first embodiment, each sheet storage portion is provided with an individual actuator that drives the push-out unit of the sheet storage portion. Therefore, even when jobs of the same user are stored in a plurality of sheet storage portions, it is possible to discharge sheets so that the user can receive sheets at the same time by driving each actuator. Hence, even when jobs of the same user are stored in a plurality of sheet storage portions, it is possible to receive sheets from a plurality of sheet storage portions at the same time by displaying one portion that indicates the user on the operation display unit and by only operating the one portion. Similarly, in the method of the ID card authentication, it is possible to receive sheets at the same time from a plurality of sheet storage portions in which sheets corresponding to user information of the ID card are stored.

Figure 5:
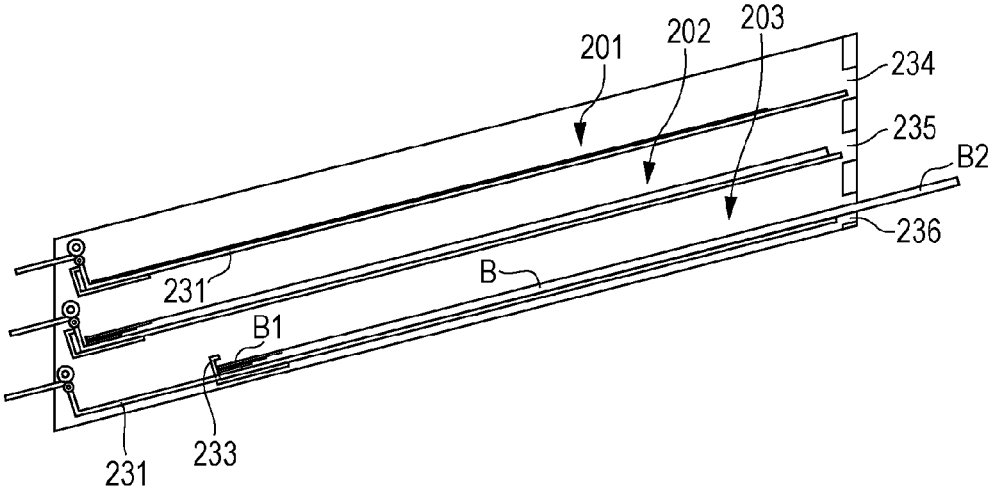
FIG. 5 is a diagram showing a configuration of the sheet storage portions of the first embodiment of the present invention.

The third sheet storage portion 203 in FIG. 5 shows a state in which sheets are pushed out and discharged. An upstream end B1 of a sheet bundle B stacked on the stacking surface 231 is pushed out by the push-out unit 233. Thereby, the sheet bundle B moves in the downstream direction and passes through the discharge port 236, and the conveying direction downstream end B2 of the sheet bundle B is exposed to the outside of the apparatus main body.

Figure 6:
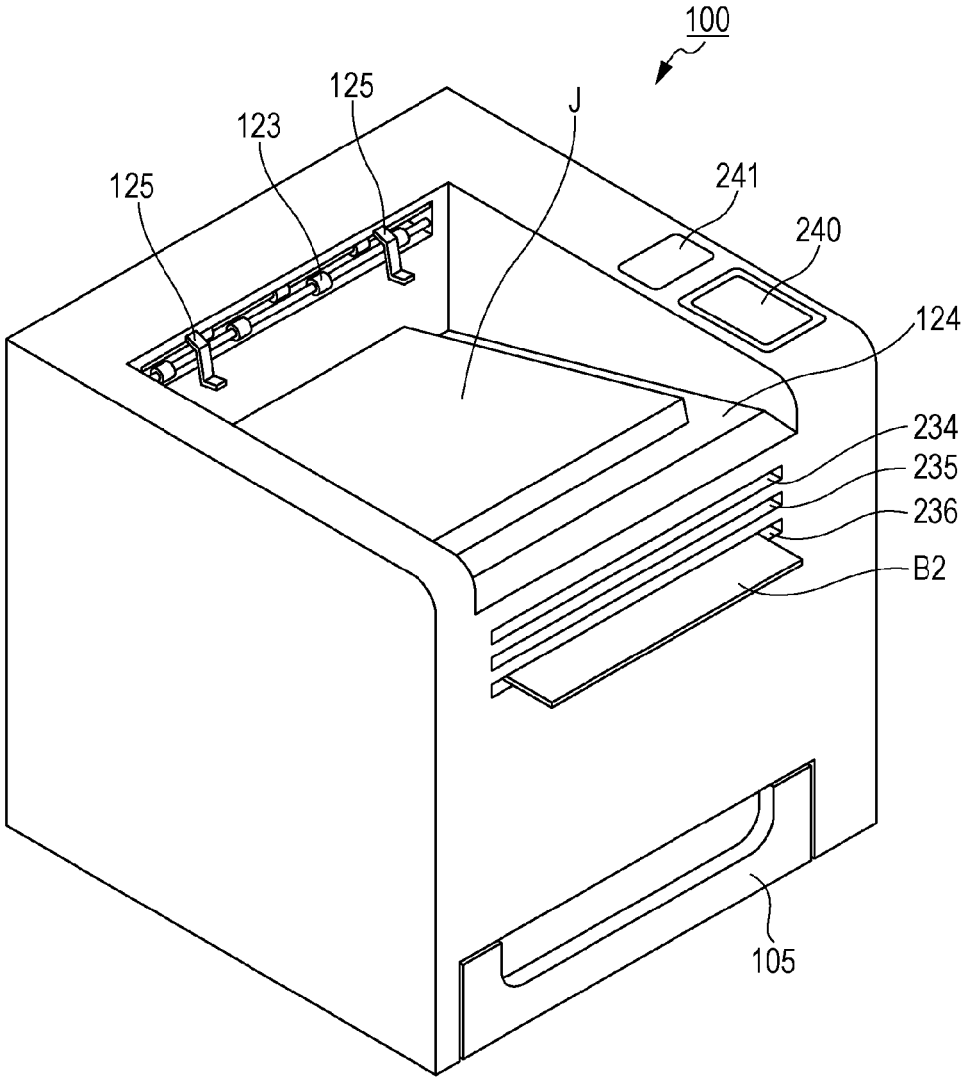
FIG. 6 is an external perspective view of the first embodiment of the image forming apparatus to which the present invention is applied.

FIG. 6 shows a perspective view of the apparatus main body 100 at this time. A printed job J of a plurality of users is stacked on the stacker portion 124 and the downstream end B2 of the sheet bundle B discharged from the third sheet storage portion 203 is exposed from the discharge port 236. A user can receive the sheet bundle of the user by catching the downstream end B2 exposed to the outside of the apparatus and pulling out the sheet bundle B.

At this time, it is desired that the amount of exposure of the sheet bundle B is set so that the center of gravity of the sheet bundle B does not go beyond the discharge port 236. This is because if the center of gravity of the sheet bundle B is pushed out to a position beyond the discharge port 236, the sheet bundle B slips out of the discharge port 236 before the user receives the sheet bundle B.

A discharge sensor, which is not shown in the drawings and which functions as a detection unit to detect that a user pulls out the sheet bundle B, is provided near the discharge ports 234 to 236. When the discharge sensor not shown in the drawings detects that a user pulls out the sheet bundle B, the push-out unit 233 moves from the push-out position to the stacking position. Further, the sheet presence/absence detection unit detects that no sheet is stacked on the sheet storage portion, so that the control unit deletes sheet storage information and the sheet storage portion becomes in a state in which the sheet storage portion can store new sheets.

As shown in FIG. 7A, the sheet storage portions 201 to 203 can integrally rotate around a fulcrum of rotation X. Further, as shown in FIG. 7B, it is possible to take out a process cartridge 150 after rotating the sheet storage portions. The fulcrum of rotation X is provided on a downstream side of the conveying rollers that conveys a sheet to the sheet storage portions in the sheet conveying direction.

In this way, the sheet storage portions 201 to 203 can be integrally opened, so that even when a jam occurs in any one of the sheet storage portions 201 to 203, the jam can be removed by the same operation. Further, it is not necessary to provide a mechanism for individually opening each of the sheet storage portions 201 to 203, so that the jam can be removed by a simple configuration.

As described above, according to the first embodiment, the sheet storage portions are provided above the image forming unit 101 and below the stacker portion 124. Therefore, it is possible to arrange the stacker portion 124 and the discharge ports of the sheet storage portions to be near each other. Thus, when a user receives any sheet, the user can receive the sheet without being forced into an unnatural posture. Further, since the stacker portion 124 is disposed on the upper surface of the apparatus, the sheets stacked on the stacker portion can be easily seen and easily taken out.

In the first embodiment, a configuration is described in which three sheet storage portions are provided. However, the number of the sheet storage portions is not limited to three. The number of the sheet storage portions and the number of sheets that can be stored in each sheet storage portion may be set according to an environment in which the apparatus main body is used, the number of users who use the apparatus main body, and the specification of the apparatus main body.

Second Embodiment

Figure 8:
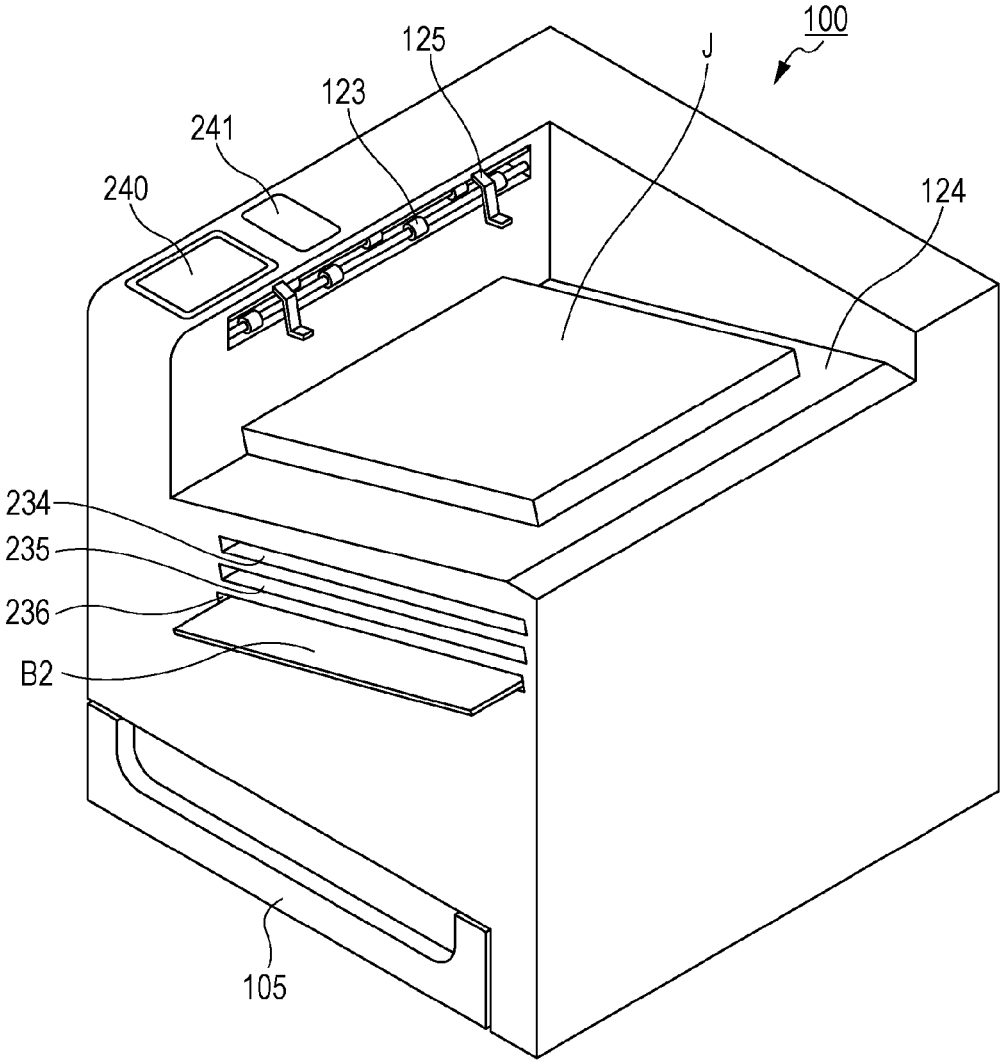
FIG. 8 is an external perspective view of a second embodiment of an image forming apparatus to which the present invention is applied.

Next, a second embodiment of the present invention will be described with reference to FIG. 8. In the second embodiment, only the direction in which the sheets are discharged from the sheet storage portions is different from that of the first embodiment and the other configuration is the same as that of the first embodiment, so that the description will be appropriately omitted.

In the second embodiment, the direction in which the sheet is discharged to the stacker portion 124 by the reverse rotation roller 123 and the direction in which the sheets are discharged from the sheet storage portions by the push-out unit are perpendicular to each other. Accordingly, the direction in which the sheet feed cassette 105 is pulled out and the position of the operation display unit 240 are changed.

In the same manner as in the first embodiment, also in the second embodiment, it is possible to arrange the stacker portion 124 and the discharge ports 234 to 236 of the sheet storage portions to be closely near each other. Therefore, when a user receives any sheet, the user can receive the sheet without being forced into an unnatural posture.

Third Embodiment

Figure 9:
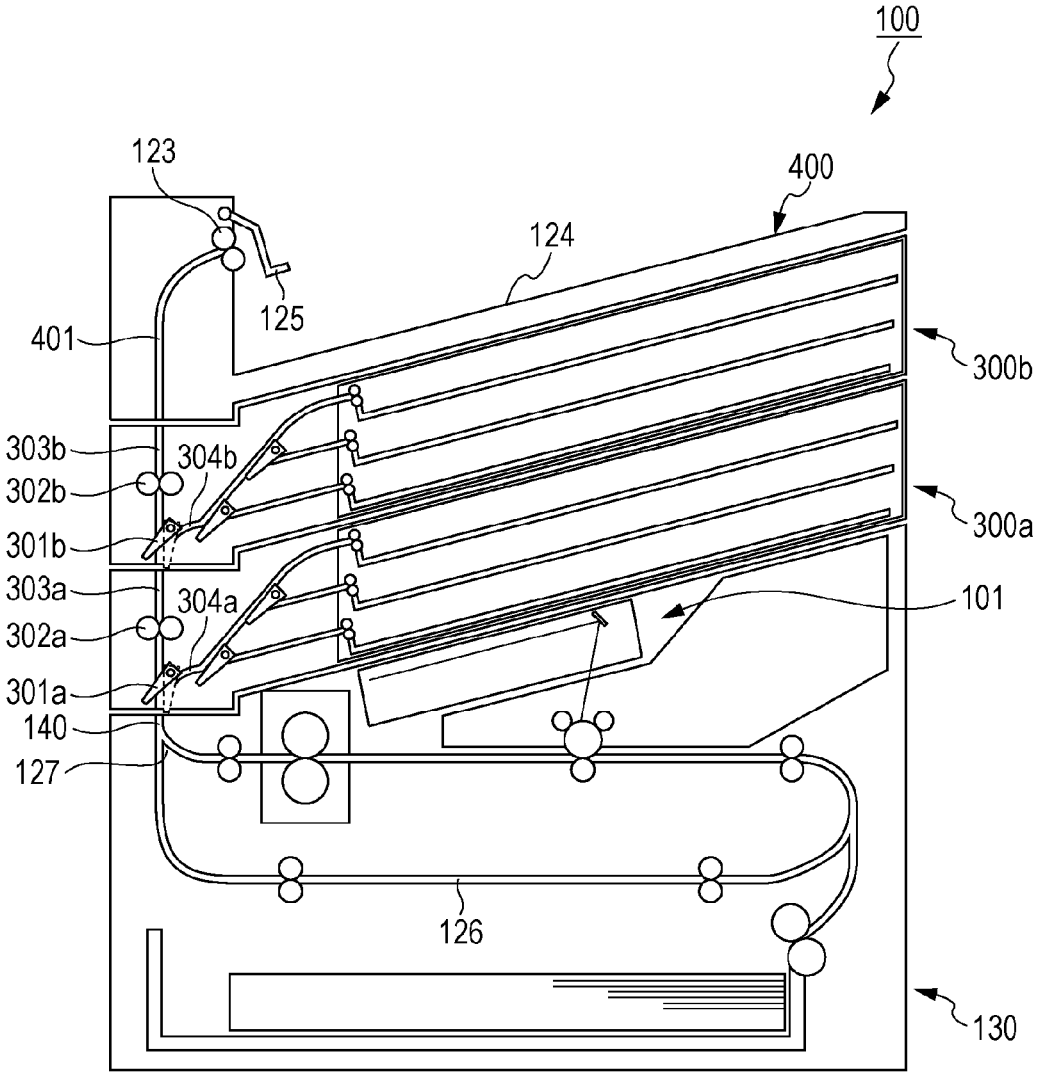
FIG. 9 is a diagram showing a third embodiment of an image forming apparatus to which the present invention is applied.

Next, a third embodiment of the present invention will be described with reference to FIGS. 9 and 10.

In the third embodiment, there are two sheet storage units 300*a* and 300*b* in each of which three sheet storage portions are piled vertically. The sheet storage units 300*a* and 300*b* have the same configuration. Reference numeral 400 denotes a stacker unit for stacking sheets on the stacker portion 124. The sheet storage units 300*a* and 300*b* and the stacker unit 400 are removably stacked on a main body unit 130.

Figure 10:
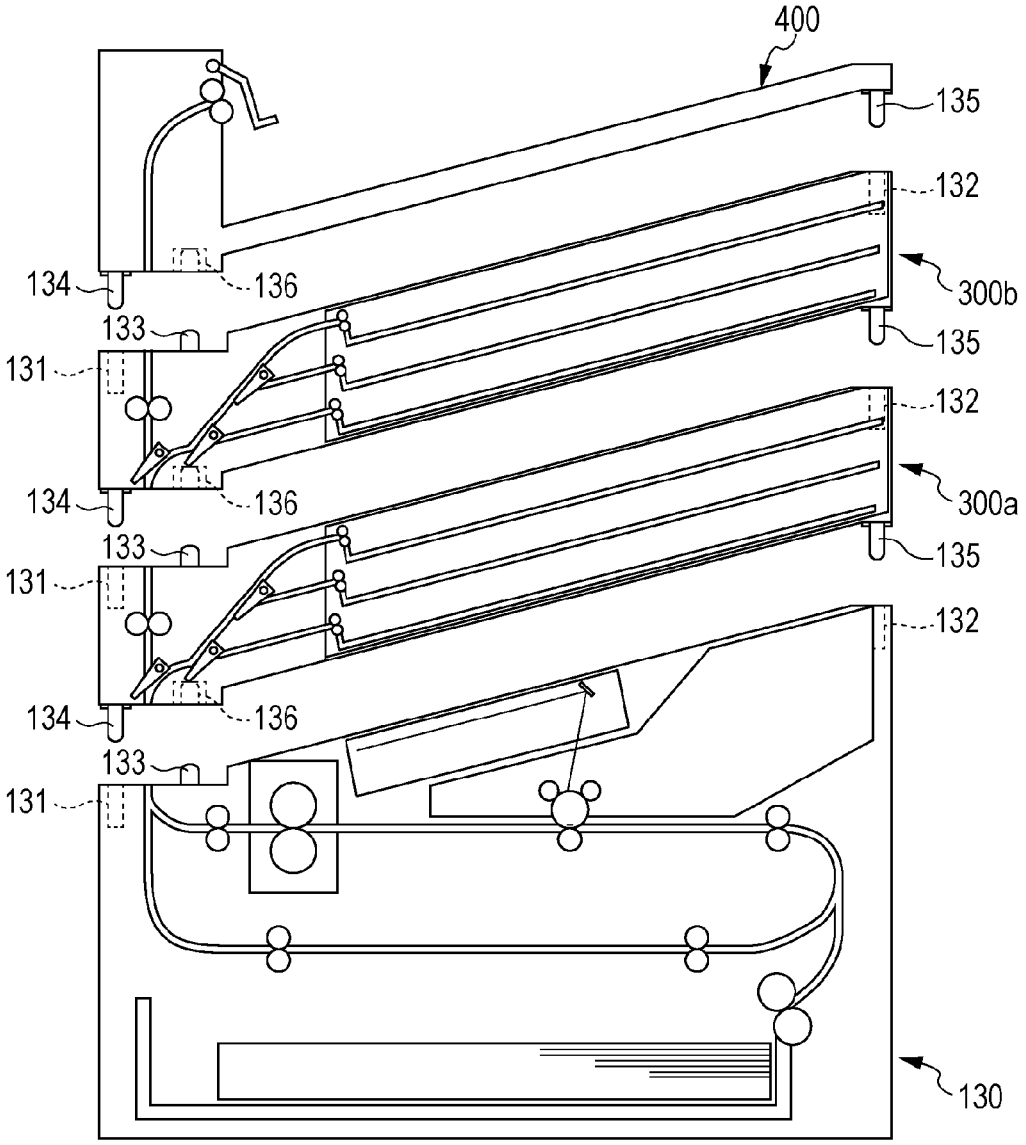
FIG. 10 is a diagram showing the third embodiment of the image forming apparatus to which the present invention is applied.

FIG. 10 is a diagram showing these units with a vertical gap in between for explaining each connection portion. The upper surface of the main body unit 130 includes positioning holes 131 and 132 to which the sheet storage unit 300*a* or 300*b* or the stacker unit 400 is connected. Also, the upper surface of the main body unit 130 includes a drawer connector 133. Positioning pins 134 and 135 and a drawer connector 136 are provided on the lower surface of the sheet storage units 300*a* and 300*b*.

When the positioning pins 134 and 135 are inserted into the positioning holes 131 and 132, the main body unit 130 and the sheet storage units 300*a* and 300*b* are positioned relative to each other. At this time, the drawer connectors 133 and 136 are connected to each other. The drawer connectors include a signal line, a power line, and a ground line, so that the drawer connectors can transmit signals and supply electric power.

Similarly, positioning holes 131 and 132 and a drawer connector 133 are provided on the upper surface of sheet storage units 300*a* and 300*b* and positioning pins 134 and 135 and a drawer connector 136 are provided on the lower surface of the stacker unit 400.

The main body unit 130 includes a sheet conveying path 140 through which a sheet on which an image is formed is conveyed to the sheet storage unit or the stacker unit. The sheet on which an image is formed is conveyed vertically from the upper surface of the main body unit 130.

In this way, the sheet storage units and the stacker unit are removably stacked, so that the number of the sheet storage units attached to the apparatus main body 100 can be changed according to an operating environment. For example, the following change can be made: When the apparatus main body 100 is shared by several users, only one sheet storage unit is mounted, and when the apparatus main body 100 is shared by tens of users, a plurality of sheet storage units are mounted. Further, when the user does not need the sheet storage unit, the stacker unit 400 can be mounted immediately above the apparatus main body 130.

Fourth Embodiment

Next, a fourth embodiment of the present invention will be described with reference to FIGS. 11A, 11B, 12A, 12B, and 12C. In the fourth embodiment, only the configuration of the conveying path through which the sheet on which an image is formed is conveyed and the position at which the switching member is provided are different from those of the first embodiment and the other configuration is the same as that of the first embodiment, so that the description will be appropriately omitted.

Figure 11A:
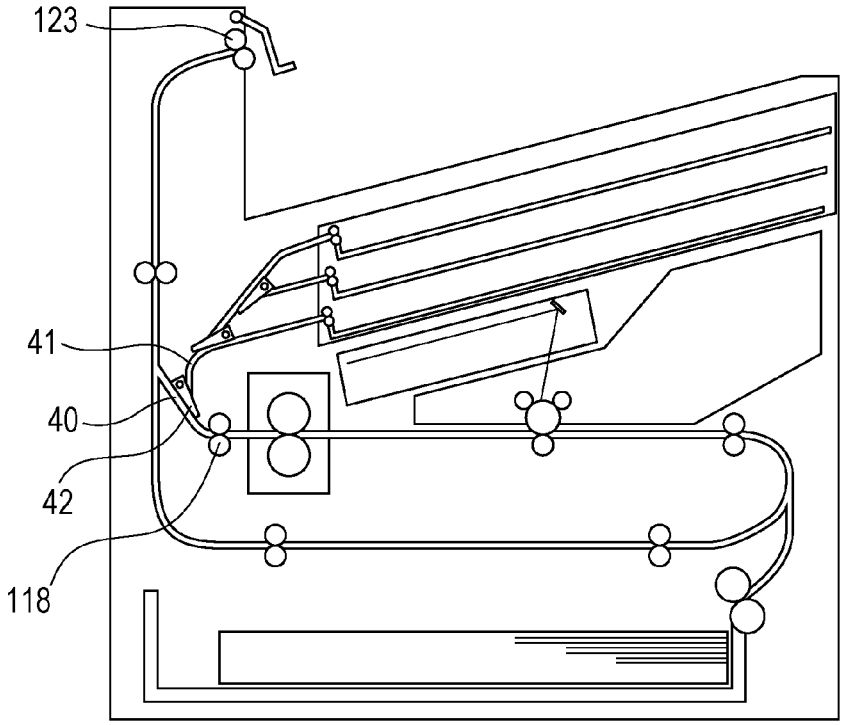
FIG. 11A is a diagram showing a fourth embodiment of an image forming apparatus to which the present invention is applied.
Figure 11B:
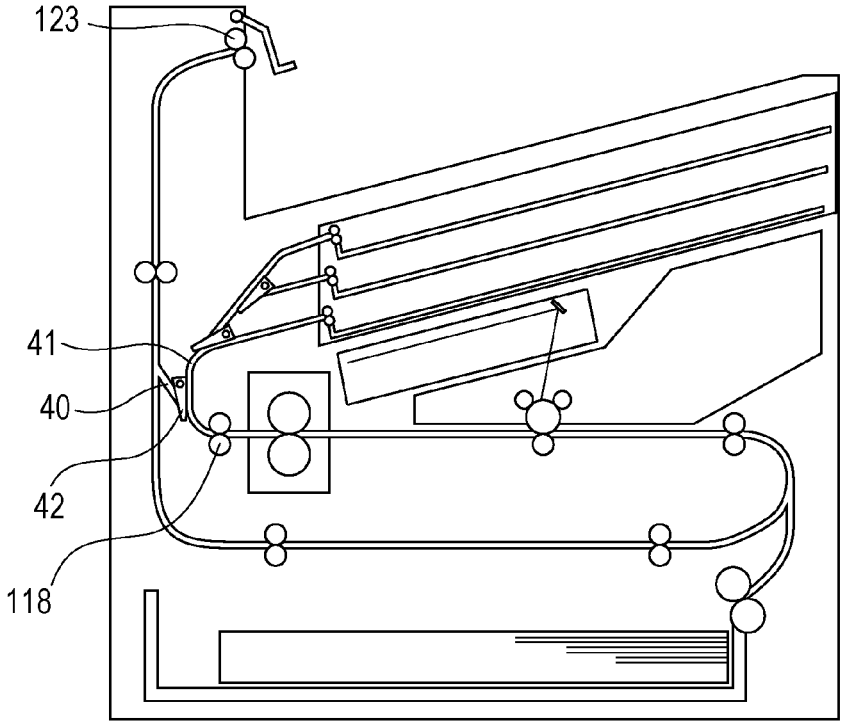
FIG. 11B is a diagram showing the fourth embodiment of the image forming apparatus to which the present invention is applied.

As shown in FIGS. 11A and 11B, the conveying path through which the sheet conveyed by the conveying roller 118 passes branches to a first conveying path 40 through which the sheet is conveyed to the reverse rotation roller 123 and to a second conveying path 41 through which the sheet is conveyed to the sheet storage portions. As shown in FIG. 11A, when the conveying path switching member 42 is located at a first position, the sheet is conveyed to the reverse rotation roller 123. As shown in FIG. 11B, when the conveying path switching member 42 is located at a second position, the sheet is conveyed to the sheet storage portions through the second conveying path. The position of the conveying path switching member 42 can be switched between the first position and the second position by an actuator not shown in FIG. 1.

Figure 12A:
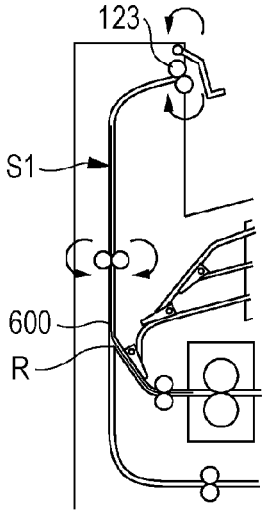
FIG. 12A is a diagram showing the fourth embodiment of the image forming apparatus to which the present invention is applied.
Figure 12B:
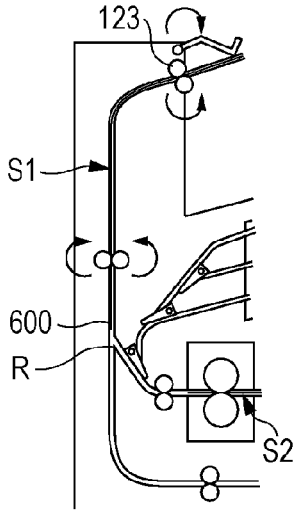
FIG. 12B is a diagram showing the fourth embodiment of the image forming apparatus to which the present invention is applied.
Figure 12C:
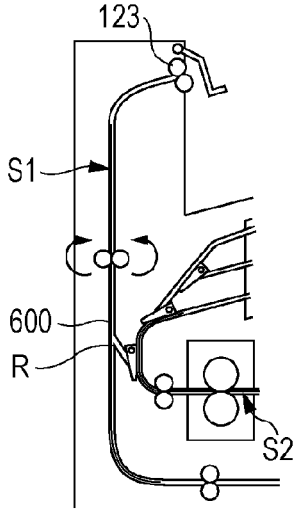
FIG. 12C is a diagram showing the fourth embodiment of the image forming apparatus to which the present invention is applied.

An operation in which images are formed on both sides of the sheet will be described with reference to FIGS. 12A, 12B, and 12C. As shown in FIG. 12A, the position of the conveying path switching member 42 is switched and the preceding sheet S1 on a first side of which an image is formed is conveyed to the reverse rotation roller 123. As shown in FIG. 12B, after the rear end of the sheet S1 passes through a branch portion R, the reverse rotation rollers 121 and 123 are rotated in the reverse direction, so that the sheet S1 is switched back and conveyed to the image forming unit 101 through a reverse path 600. As shown in FIG. 12C, even when the preceding sheet S1 is passing through the reverse path 600, the following sheet S2 can be conveyed to the sheet storage portions through the second conveying path.

Therefore, according to the fourth embodiment, even when the preceding sheet is being conveyed for reverse printing, the following sheet can be conveyed to the sheet storage portions.

Although the embodiments of the present invention have been described in detail, the first to the fourth embodiments can be combined with each other and used.

Modified Embodiment

In the first to the fourth embodiments, a configuration is described in which each sheet storage portion has an actuator that drives the push-out unit. However, the number of the actuators can be smaller than that of the sheet storage portions. For example, a drive transmission switching unit that can selectively switch ON/OFF of a drive transmission state of a drive from the actuator may be provided so that a plurality of push-out units can be moved by one actuator. Thereby, the number of the actuators can be reduced.

Figure 13:
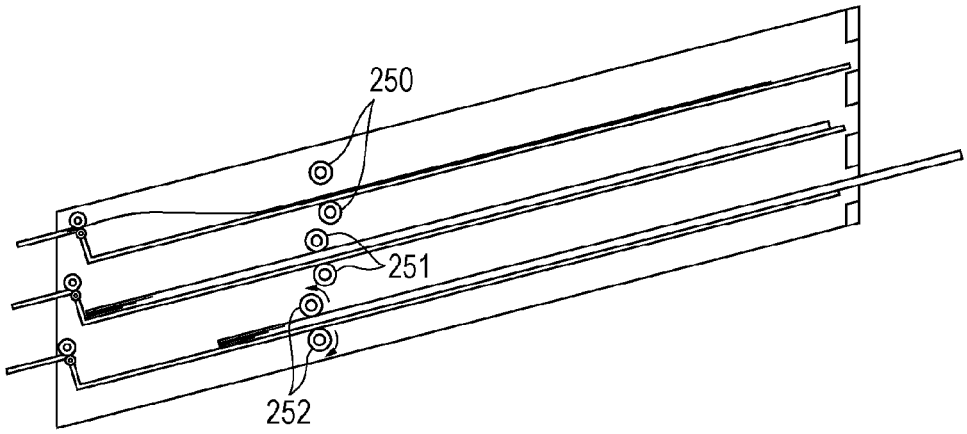
FIG. 13 is a diagram showing a modified example of a push-out unit.

In the first to the fourth embodiments, a configuration is described in which the rear end pressure hooks push out the sheets. However, in the present invention, the configuration of the push-out unit should not be limited to this configuration. For example, a pair of detachable rollers as shown in FIG. 13 may be used as a push-out unit. When a sheet is conveyed to the sheet storage portion, the rollers are away from each other as shown by a pair of rollers 250, so that the rollers do not prevent the sheet from being conveyed. When the sheet bundle is discharged, the rollers come into contact with the upper surface and the lower surface of the stored sheets, respectively, and nip the sheet bundle as shown by a pair of rollers 251. Further, the rollers rotate in directions indicated by arrows shown around a pair of rollers 252, so that the sheets stored in the sheet storage portion are discharged.

Figure 14:
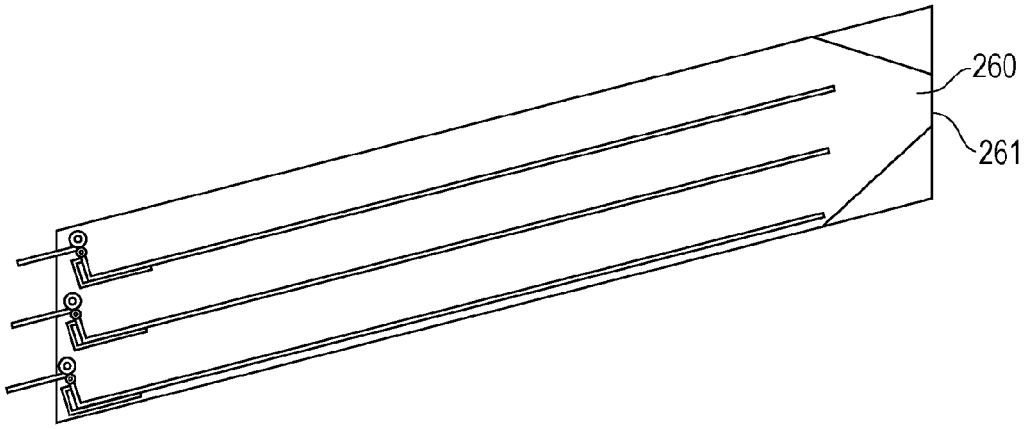
FIG. 14 is a diagram showing a modified example of a discharge port.

In the first to the fourth embodiments, a configuration is described in which each sheet storage portion has one discharge port. However, the present invention should not be limited to this. For example, as shown in FIG. 14, the sheet storage portions are merged at a merged portion 260 on the downstream side in the conveying direction and the sheet storage portions may have only one shared discharge port 261. In this case, even when the jobs of a user are separately stored in a plurality of sheet storage portions, the user can receive the plurality of jobs of the user as one sheet bundle by driving the push-out units of the plurality of sheet storage portions at the same time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-094054, filed Apr. 17, 2012, which is hereby incorporated by reference herein in its entirety.

REFERENCE SIGNS LIST

100 Image forming apparatus main body
101 Image forming unit

124 Stacker unit
201 First sheet storage portion
202 Second sheet storage portion
203 Third sheet storage portion
204 Conveying roller
205 Conveying roller
206 Conveying roller
234 Discharge port
235 Discharge port
236 Discharge port
233 Push-out unit
B Sheet bundle
X Fulcrum of rotation

The invention claimed is:

1. An image forming apparatus comprising:

an apparatus main body formed with a first opening portion and a second opening portion;

an image forming unit configured to form an image on a sheet;

a stacker portion configured to stack the sheet on which the image has been formed by the image forming unit, and which has been conveyed outside of the apparatus main body through the first opening portion;

a sheet storage portion configured to store the sheet on which the image has been formed by the image forming unit inside the apparatus main body in a state in which the sheet is not able to be taken out from the outside of the apparatus main body; and a sheet moving unit configured to move the sheet stored in the sheet storage portion and to stop the sheet in a state in which a front end of the sheet in a movement direction is exposed from the second opening portion to the outside of the apparatus main body, wherein the sheet storage portion is provided above the image forming unit and below the stacker portion in a vertical direction.

2. The image forming apparatus according to claim 1, wherein the sheet storage portion is configured to integrally rotate about one fulcrum of rotation.

3. The image forming apparatus according to claim 2, further comprising a conveying unit configured to convey a sheet to the sheet storage portion, wherein the one fulcrum of rotation is provided on a downstream side of the conveying unit in a sheet conveying direction.

4. The image forming apparatus according to claim 2, wherein the image forming unit includes a process cartridge configured to be pulled out from the apparatus main body after the sheet storage portion rotates about the one fulcrum of rotation.

5. The image forming apparatus according to claim 1, further comprising a plurality of the sheet storage portions arranged in the vertical direction, wherein the second opening portion is used as a common opening portion from which respective sheets stored in the plurality of sheet storage portions is exposed to the outside of the apparatus main body.

6. The image forming apparatus according to claim 1, wherein the sheet moving unit pushes a rear end of the sheet in the movement direction and stops the sheet in the state in which the front end of the sheet is exposed from the second opening portion to the outside of the apparatus main body.

7. The image forming apparatus according to claim 1, further comprising:

a memory unit configured to memorize a user who issued a print instruction for the sheets stored in the sheet storage portion; and an authentication unit configured to authenticate a user, wherein, when the user authenticated by the authentication unit and the user memorized in the memory unit are the same, the sheet moving unit moves the sheet stored in the sheet storage portion and stops the sheet in the state in which the front end of the sheet is exposed from the second opening portion to the outside of the apparatus main body.

8. The image forming apparatus according to claim 7, wherein the authentication of a user by the authentication unit is performed when the user causes a read unit, provided in the apparatus main body and which reads an identification (ID) card, to read an ID card.

9. The image forming apparatus according to claim 7, wherein the authentication of a user by the authentication unit is performed when the user inputs user information into an operation unit provided on the apparatus main body.

10. The image forming apparatus according to claim 1, wherein the sheet storage portion is removably attached to the apparatus main body.

11. The image forming apparatus according to claim 1, wherein the sheet storage portion further is provided in a vertical direction directly above the image forming unit, wherein the image forming unit includes a photosensitive drum to form the image on a sheet, and wherein the photosensitive drum is positioned below the sheet storage portion in the vertical direction.

12. The image forming apparatus according to claim 1, further comprising a plurality of the sheet storage portions arranged in the vertical direction, wherein a plurality of second opening portions that correspond to the plurality of sheet storage portions are formed in the apparatus main body.

13. The image forming apparatus according to claim 1, wherein a length of a stacking surface of the sheet storage portion in the movement direction is set to a length in which the front end of the sheet does not protrude from the second opening portion so that the sheet is not able to be taken out from the outside of the apparatus main body, even when a predetermined sheet is stored in the sheet storage portion, the predetermined sheet having the longest sheet length in the movement direction among sheet lengths which the image forming apparatus is capable of dealing with.

14. The image forming apparatus according to claim 1, wherein the image forming unit includes a transfer portion configured to transfer the image onto the sheet.

15. The image forming apparatus according to claim 1, wherein the stacker portion is provided on an upper surface of the apparatus main body in the vertical direction.

16. The image forming apparatus according to claim 1, wherein the sheet storage portion is capable of storing a plurality of sheets.

17. The image forming apparatus according to claim 1, wherein the sheet stacked on the stacker portion and the front end of the sheet exposed from the second opening portion to the outside of the apparatus main body do not overlap with each other in the vertical direction.

18. The image forming apparatus according to claim 1, wherein a direction in which the sheet is discharged to the outside of the apparatus main body through the first opening portion is the same as a direction in which the front end of the sheet is exposed from the second opening portion to the outside of the apparatus main body.

19. The image forming apparatus according to claim 1, wherein the sheet moving unit moves the sheet in such a way that the center of gravity of the sheet stored in the sheet storage portion does not go beyond the second opening portion.

* * * * *